US009116511B2

(12) United States Patent
Bang et al.

(10) Patent No.: US 9,116,511 B2
(45) Date of Patent: Aug. 25, 2015

(54) SELF TEMPERATURE-COMPENSATED HIGH PRECISION EVENT TIMER USING STANDARD TIME REFERENCE FREQUENCY AND ITS METHOD

(75) Inventors: Seung-Cheol Bang, Seoul (KR); Hyung Chul Lim, Daejeon (KR); Jong Uk Park, Daejeon (KR)

(73) Assignee: Korea Astronomy and Space Science Institute, Daejeon (KR)

( * ) Notice: Subject to any disclaimer, the term of this patent is extended or adjusted under 35 U.S.C. 154(b) by 978 days.

(21) Appl. No.: 13/278,879

(22) Filed: Oct. 21, 2011

(65) Prior Publication Data

US 2013/0013254 A1 Jan. 10, 2013

(30) Foreign Application Priority Data

Jul. 5, 2011 (KR) ..... 10-2011-0066270

(51) Int. Cl.

*G04F 10/00* (2006.01)
*G04G 3/04* (2006.01)
*G04F 10/04* (2006.01)

(52) U.S. Cl.

CPC ..... *G04F 10/005* (2013.01); *G04G 3/04* (2013.01); *G04F 10/00* (2013.01); *G04F 10/04* (2013.01)

(58) Field of Classification Search

CPC ..... G04G 3/04; G04F 10/00; G04F 10/04; G04F 10/005

See application file for complete search history.

(56) References Cited

U.S. PATENT DOCUMENTS

| | | | | |
|---|---|---|---|---|
| 5,903,523 | A * | 5/1999 | Peck | 368/202 |
| 6,133,992 | A * | 10/2000 | Tanaka et al. | 356/5.07 |
| 6,137,749 | A * | 10/2000 | Sumner | 368/113 |
| 6,717,656 | B2 * | 4/2004 | Chien et al. | 356/5.01 |
| 2005/0122846 | A1 * | 6/2005 | Bolli et al. | 368/118 |
| 2005/0211893 | A1 * | 9/2005 | Paschalidis | 250/287 |
| 2012/0194798 | A1 * | 8/2012 | Crawford et al. | 356/4.02 |

OTHER PUBLICATIONS

Paschalidis et al., "A CMOS Time-of-Flight System-on-a-Chip for Spacecraft Instruments" IEEE Transactions on Nuclear Science, vol. 49, No. 3, Jun. 2002.*

Cavanaugh et al., "The Mercury Laser Altimeter Instrument for the MESSENGER Mission" Space Sci Rev (2007) 131: 451-479.*

Kalisz et al. "Improved Time-Interval Counting Techniques for Laser Ranging Systems" IEEE Transactions on Instrumentation and Measurement. vol. 42, No. 2, Apr. 1993.*

(Continued)

*Primary Examiner* — Mohamed Charioui
*Assistant Examiner* — John Kuan
(74) *Attorney, Agent, or Firm* — Birch, Stewart, Kolasch & Birch, LLP

(57) ABSTRACT

The present invention makes it possible to measure a precision event time in such a way to make a reference data in accordance with a standard time reference frequency signal and to make a measurement data by using an apparatus with the same structure as a reference data with respect to a signal to be measured and to compare the measurement data with a reference data, whereby temperature effects can be minimized by making the time changes due to temperature changes occurring between two apparatuses happen equally, by providing the same structure and parts to a reference signal circuit apparatus for an event time measurement and a signal circuit apparatus to be measured, and the zero point adjustment is performed during the real time operation, so the system is not needed to stop.

6 Claims, 5 Drawing Sheets

(56) References Cited

OTHER PUBLICATIONS

Kalisz et al., "Precision time counter for laser ranging to satellites" Review of Scientific Instruments 65, 736 (1994).*
Kalisz, "Review of methods for time interval measurements with picosecond resolution" Metrologia 41 (2004) 17-32.*
Murphy t al., "APOLLO: the Apache Point Observatory Lunar Laser-ranging Operation: Instrument Description and First Detections" arXiv:0710.0890v2 [astro-ph], 2007; available at http://arxiv.org/abs/0710.0890v2.*
Karadamoglou et al., "An 11-bit High-Resolution and Adjustable-Range CMOS Time-to-Digital Converter for Space Science Instruments" IEEE Journal of Solid-State Circuits, vol. 39, No. 1, Jan. 2004.*

* cited by examiner

SELF TEMPERATURE-COMPENSATED HIGH PRECISION EVENT TIMER USING STANDARD TIME REFERENCE FREQUENCY AND ITS METHOD

TECHNICAL FIELD

The present invention relates to a high precision event timer, and in particular to a self temperature-compensated high precision event timer using a standard time reference frequency and its method which make it possible to measure a precision event time in such a way to make a reference data in accordance with a standard time reference frequency signal and to make a measurement data by using an apparatus with the same structure as a reference data with respect to a signal to be measured and to compare the measurement data with a reference data, whereby temperature effects can be minimized by making the time changes, which would occur due to temperature changes occurring between two apparatuses, happen equally, by providing the same structure and parts to a reference signal circuit apparatus for an event time measurement and a signal circuit apparatus.

BACKGROUND ART

A distance measurement method using a pulse laser is, generally, directed to computing a flight time of a precision laser in such a way that a laser with a shorter pulse width is emitted to an object to be measured, and a travel start time of an emitted laser is precisely measured, and an arrival time of a laser which returns after reflection on an object, the distance of which will be measured, is preciously measured, and a travel start time is subtracted from an arrival time of a laser. The distance from a laser emitting point to an object is computed by dividing, by two, the value which is obtained by multiplying the speed of light ($c=2.99792458\times10^8$ m/s) by the two-way flight time of the laser. Here, what the time difference is divided by two is to compute one-way distance since light travels two ways, namely, it travels and then reflects on the object the distance of which is to be measured.

As shown in FIG. 1, the construction of the conventional high precision event timer will be described.

In other words, the conventional high precision event timer is formed of an event time signal detector 1 and a signal processor 9. The event time signal detector 1 serves to detect a signal (measurement signal) to be measured, and serves to arrange signals before the next block processes digital signals and to convert into digital signals. The signal processor 9 serves to obtain a precision event time in accordance with the signal converted into a digital form by the previous block.

As shown in FIGS. 1 and 2, the operation of the event time signal detector 1 is as follows.

The input signal (measurement signal) 11 needed for an event time measurement is converted into a signal 12 having a constant pulse width into an input signal processor CFD (Constant Fractional Discriminator) 2 of a time signal detector 1.

The conventional CFD 2 serves to make the pulse size and width constant so that the measurement values are not affected by the change of the input signal, otherwise, the results of the measurements by the next block might be affected when the sizes of the signals of a the analog type pulse waves are not uniform. The major elements belonging to the CFD 2 are a signal delay line and a voltage comparator.

The output signal of the CFD 2 having a constant pulse width irrespective of the pulse width of the input signal 11 is inputted into an integrator 4. The short pulse signal inputted into the integrator 4 is outputted in a tooth-shaped wave 13 longer than the width of the pulse.

The major elements belonging to the analog type integrator 4 are a capacitor and a computation amplifier (OP Amp).

Since it is impossible to measure the pulse time of the input signal in a method that the number of common digital pulses is counted since the operation speed of the signal to be measured is higher than the maximum operation seed of a digital semiconductor, the integrator performs a process for extending the input signal longer by an analog method.

The output signal 13 of the integrator 4 is inputted into an analog-digital converter (ADC) 5.

The analog-digital converter 5 serves to measure the voltage value based on the time of the inputted tooth-shaped wave and to transmit a signal controller 6.

A frequency multiplier 7 serves to convert the inputted low frequency signal 15 into a high frequency signal 14 which is needed at the analog-digital converter 5.

There are a variety of diverse frequency multipliers depending on the required frequency or use purposes. A voltage controlled oscillator (VCO) is mainly used, which uses a crystal oscillator when the frequency stability is high, but the frequency is low like the high precision event timer.

The controller 6 is characterized to add to the data inputted from the analog-digital converter 5, the information about the sampling time in accordance with 1 pps (Pulse per Second), which informs time of one second unit with the aid of the frequency multiplier 7, and then to transmit to an external signal processor 9.

The signal processor 9 determines a precision event time in accordance with the value of the analog-digital converter 5 transferred from the event time signal detector 1 and a time data corresponding to the value. The precision event time is determined in accordance with an inherent characteristic value 10 of the time detector in addition to the real time information inputted from the time detector when determining the precision event time.

The reference time in the apparatus which measures time corresponds to a reference signal which is important when determining the precision of the time meter, and the reference time of the conventional precision event time meter serves to generate a high frequency signal by multiplying a time sync frequency of the time meter inputted, which frequency becomes a reference time. The time of the input signal is determined in accordance with a data digitally sampled based on the reference frequency.

The detection of the actual time is performed by a digital method which is less affected by the temperature; however the CFD 2 and the integrator 4 and the frequency multiplier 7 process the signals by the analog method which is sensitive to the changes of temperature during the signal process, so the result values change sensitively to the changes of temperature. In order to overcome the above problems, the conventional high precision event timer is directed to installing a temperature control heater 3, 8 at the CFD 2 and the integrator 4 and the frequency multiplier 7, respectively, thus keeping the changes of the temperature small.

The conventional high precision event timer with the above construction needs a temperature control heater 3, 8 in order to improve the operation characteristics with respect to the temperatures of parts; however since the elements belonging to the CFD 2 and the integrator 4 both determining the precision of time in the precision event timer and the elements belonging to the frequency multiplier 7 are different from each other and have different characteristics with respect to the temperature, their characteristics change differently depending on the small changes of temperatures, so the measured result values change depending on the surrounding temperature.

In other words, in case of the capacitor which is a major element of the integrator 4, capacitance might change depending on temperature, and in case of the frequency multiplier 7, the frequency or phase of the signal might change. Since the waves are formed by the CFD 2 using a delay line the volume of which is larger than electronic elements, there are a lot of problems in manufacturing a small size high precision event timer. The characteristics of delay lines are different depending on parts since the delay lines are made manually, which results in different inherent characteristics at each time signal detector which is made from the above problematic parts. Since the signal processor 9, which generally determines precision event time, determines precision event time based on the result value of the analog-digital converter 5 having time information and the inherent characteristics of the detector which are determined during the manufacture of the time signal detector 1, it is needed to form the signal processor 9 by using a personal computer PC with an ability of computing complicated processes.

DISCLOSURE OF THE INVENTION

Accordingly, the present invention is made in order to overcome the above-mentioned problems.

It is an object of the present invention to provide a self temperature-compensated high precision event timer using a standard time reference frequency and its method which make it possible to measure a precision event time in such a way to make a reference data in accordance with a standard time reference frequency signal and to make a measurement data by using an apparatus with the same structure as a reference data with respect to a signal to be measured and to compare the measurement data with a reference data, whereby temperature effects can be minimized by making the time changes, which would occur due to the temperature changes occurring between two apparatuses, happen equally, by providing the same structure and parts to a reference signal circuit apparatus for an event time measurement and a signal circuit apparatus. In addition, the zero point adjustment can be performed during a real time operation, and it does not need stop the apparatus during the zero point adjustment. A small size instrument can be manufactured in such a way that a delay circuit is made by a small size semiconductor, and an error between related instruments can be significantly reduced.

To achieve the above objects, there is provided a self temperature-compensated high precision event timer which comprises a measurement signal delay unit which converts a measurement signal into a pulse signal; a measurement signal integrator which converts an output signal from the measurement signal delay unit into a tooth-shaped waveform signal; a measurement signal analog-digital converter which converts an output signal from the measurement signal integrator into a digital signal; a reference frequency signal delay unit which converts a reference frequency signal into a pulse signal and has the same structure as the measurement signal delay unit; a reference frequency signal integrator which converts an output signal from the reference frequency signal delay unit into a tooth-shaped waveform signal and has the same structure as the measurement signal integrator; a reference frequency analog-digital converter which converts an output signal from the reference frequency signal integrator and has the same structure as the measurement signal analog-digital converter; a frequency multiplier which converts the inputted reference frequency signal into a frequency signal needed to the measurement signal analog-digital converter and the reference frequency analog-digital converter; and an event time measurement controller which processes by the digital signal process method the measurement digital data outputted from the measurement signal analog-digital converter, thus computing precision event time.

The event time measurement controller comprises an internal clock which generates a time used in the interior of the event time measurement controller, and receives a frequency signal outputted from the frequency multiplier, and is used for an event time determination of more than an analog-digital sampling period, and determines a time more than one unit second by using a 1 pps for a one unit second time recognition; a reference digital data input processor which generates a reference frequency signal analog-digital converter control signal, and controls the reference frequency signal analog-digital converter, and receives the outputted digital value; a reference data storing memory which stores the data inputted into the reference digital data input processor; a reference digital data process filter which determines the precision reference value by using multiple data stored in the reference data storing memory; a reference digital data storing register which stores the result value processed by the reference digital data processing filter; a measurement digital data input processor which generates a measurement signal analog-digital converter control signal, and controls the measurement signal analog-digital converter and receives the outputted digital value; a measurement digital temporal storing register which stores the data inputted into the measurement digital data input processor; and an event time measurement main controller which determines a time in accordance with time information measured by the internal clock when a new when new data are inputted into the measurement digital data temporal storing register for measurement, and determines a precision event time by computing the value of the measurement digital data storing register based on an output value of the reference digital data process filter stored in the reference digital data storing register.

The precision event time is determined by the following formula:

$$T_{PREC} = \left(\left(\frac{\left(\frac{rD_1 - sD_1}{rD_1 - rD_2} + \frac{rD_2 - sD_2}{rD_2 - rD_3} + \ldots + \frac{rD_{n-1} - sD_{n-1}}{rD_{n-1} - rD_n}\right)}{n-1}\right) \times T_{SP}\right) + S_0$$

where $T_{PREC}$ means precision event time, and ${}_rD_1$, ${}_rD_2$, ${}_rD_3 \ldots {}_rD_n$ means the digital data value of the reference signal, and, ${}_SD_1$, ${}_SD_2$, ${}_SD_3 \ldots {}_SD_n$ means the digital data value of the measurement signal, $T_{SP}$ means the sampling period of the analog-digital converter, and, $S_0$ means the first digital data value sampling time of the measurement signal, and, n means the number of designated samples.

The measurement signal integrator and said reference frequency signal integrator are formed of a capacitor and an OP amplifier (OP Amp), and said frequency multiplier is formed of a voltage control oscillator (VCO).

To achieve the above objects, there is provided a self temperature-compensated high precision event time measurement method which comprises a step for converting a measurement signal into a tooth-shaped waveform digital signal by using a measurement signal delay unit, a measurement signal integrator, and a measurement signal analog-digital converter; a step for converting a reference frequency signal into a tooth-shaped waveform digital signal by using a reference frequency signal delay unit, a reference frequency signal integrator and a reference frequency signal analog-digital converter which each have the same structures as each of the measurement signal delay unit, the measurement signal integrator, and the measurement signal analog-digital converter; a step for determining a time in accordance with time information measured by an internal clock; a step for determined a precision event time by using the following formula:

$$T_{PREC} = \left(\left(\frac{\left(\frac{rD_1 - sD_1}{rD_1 - rD_2} + \frac{rD_2 - sD_2}{rD_2 - rD_3} + \ldots + \frac{rD_{n-1} - sD_{n-1}}{rD_{n-1} - rD_n}\right)}{n-1}\right) \times T_{SP}\right) + S_0$$

where TPREC means precision event time, and rD1, rD2, rD3 . . . rDn means the digital data value of the reference signal, and, SD1, SD2, SD3 . . . SDn means the digital data value of the measurement signal, TSP means the sampling period of the analog-digital converter, and, S0 means the first digital data value sampling time of the measurement signal, and, n means the number of designated samples.

BRIEF DESCRIPTION OF THE DRAWINGS

The present invention will become better understood with reference to the accompanying drawings which are given only by way of illustration and thus are not limitative of the present invention, wherein.

MODES FOR CARRYING OUT THE INVENTION

The preferred embodiments of the present invention will be described with reference to the accompanying drawings.

Figure 3:
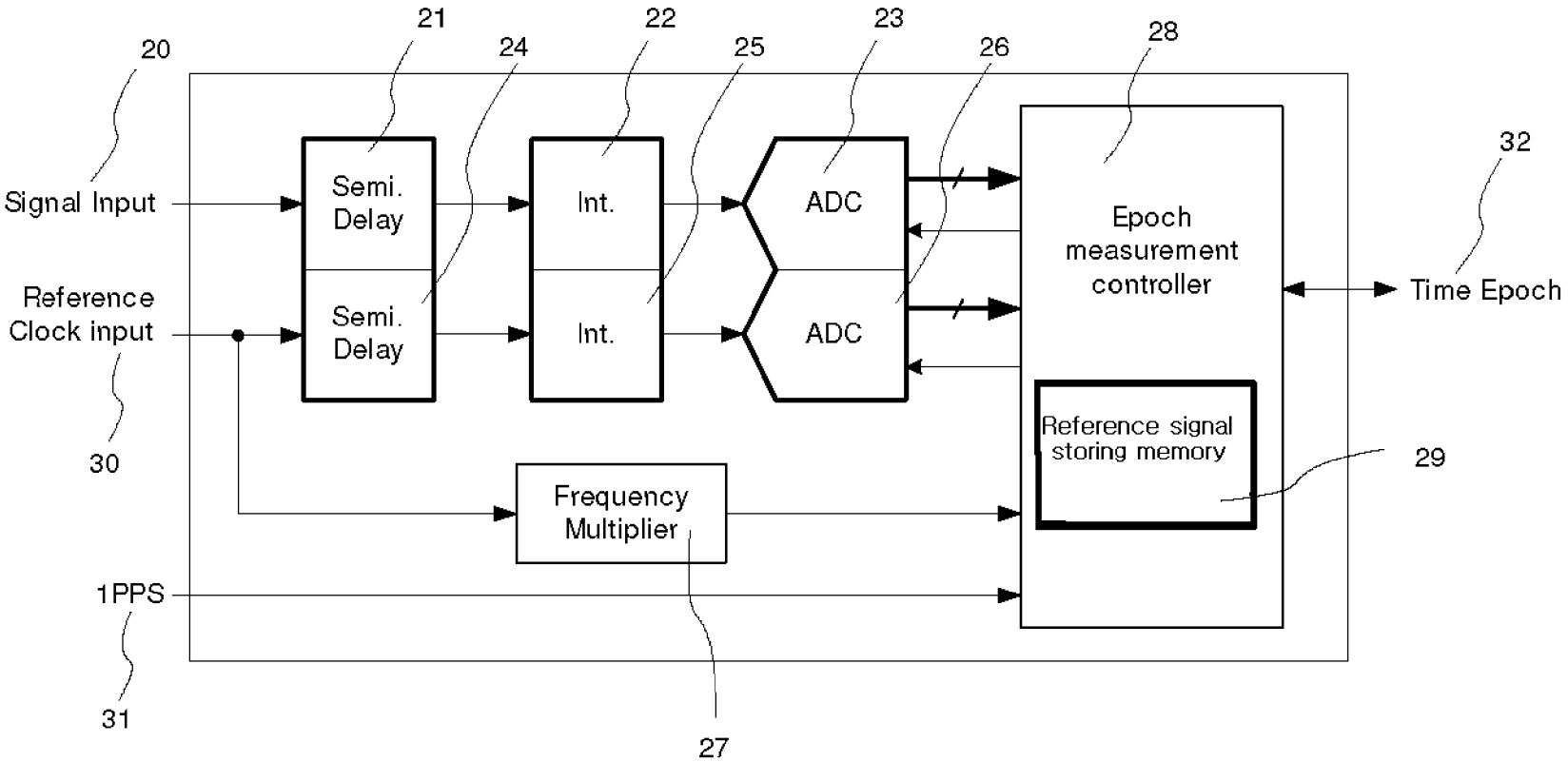
FIG. 3 is a view of a construction of a high precision event timer according to an embodiment of the present invention.

FIG. 3 is a view of a construction of a high precision event timer according to an embodiment of the present invention.

The present invention is substantially characterized in that the analog signal process procedures of a measurement signal and a reference signal are constructed in the same manner.

FIG. 3 shows a detailed analog process procedure. In the analog process procedure, the process of each signal might have different results like the conventional art depending on the electrical characteristics of electrical elements. In the present invention, the signals are processed with the same element and under the same conditions for minimizing the differences which might occur due to the changes in temperatures.

The above construction will be described in details.

As show in FIG. 3, the high precision event timer according to an embodiment of the present invention comprises a measurement signal delay unit 21, a measurement signal integrator 22, a measurement signal analog-digital converter 23, a reference frequency signal delay unit 24, a reference frequency signal integrator 25, a reference frequency signal analog-digital converter 26, a frequency multiplier 27 and an event time measurement controller 28.

The measurement signal delay unit 21 serves to convert a measurement signal into a pulse signal with a certain width.

The measurement signal integrator 22 serves to convert an output signal of the measurement signal delay unit 21 into a tooth-shaped waveform signal.

The measurement signal analog-digital converter 23 serves to convert an output signal of the measurement signal integrator 22 into a digital signal.

The reference frequency signal delay unit 24 serves a reference frequency signal into a pulse signal and has the same construction as the measurement signal delay unit 21.

The reference frequency signal integrator 25 serves an output signal of the reference frequency signal delay unit 24 into a tooth-shaped signal and has the same construction as the measurement signal integrator 22.

The reference frequency signal analog-digital converter 26 serves to convert an output signal of the reference frequency signal integrator 25 into a digital signal and has the same construction as the measurement signal analog-digital converter 23.

The frequency multiplier 27 serves to convert the inputted reference frequency signal 15 into the high frequency signals needed to the measurement signal analog-digital converter 23 and the reference frequency analog-digital converter 26.

The precision event time measurement controller 28 processes the measurement digital data 102 from the measurement signal analog-digital converter 23 in a digital signal process method and serves to compute the precision event time 32.

The above operations will be described in more details.

As shown in FIG. 3, the function block of the structure for processing the input signal and the reference clock signal in the same method is formed of an input signal process block and a reference clock signal process block.

The measurement signal (signal input) 20 and the reference frequency signal (reference clock input) 30 both to be measured are inputted into the high precision event timer of FIG. 3.

The inputted signals 20 and 30 are converted into the pulse signals each with a certain width as they pass through the measurement signal delay unit 21 and the reference signal delay unit 24. The output signals of the measurement signal delay unit 21 and the reference frequency signal delay unit 24 are inputted into the integrators 22 and 25. Here, the integrators 22 and 25 have the constructions. The signals are converted into the tooth-shaped waveform signals of FIG. 5 as they pass through the measurement signal integrator 22 and the reference frequency signal integrator 25.

The tooth-shaped signal is converted into a digital signal by the analog-digital converters (ADC) 23 and 26; in other words, the tooth-shaped measurement signal 20 is converted into a digital signal by the measurement signal analog-digital converter 23, and the tooth-shaped reference frequency signal (hereinafter refereed to reference signal) 30 is converted into a digital signal by the reference signal analog-digital converter 26.

The data converted into a digital value by the analog-digital converters (ADC) 23 and 26 are inputted into a precision event time measurement controller 28 (hereinafter referred to event time measurement controller).

The reference frequency signals (reference block input) 30 used for a standard event time determination of the inputted signal is transferred to two parts 24 and 27 by the high precision event timer of FIG. 3.

One reference frequency signal is inputted into the previously described reference frequency signal delay unit 24, and the other is inputted into the frequency multiplier 27.

The frequency multiplier 27 converts the signal to a higher frequency signal than the standard frequency inputted for a high speed signal process.

Finally, the event time measurement controller 28 measures a precision event time in a method that the measurement signal converted into a digital form by the digital signal process apparatus 23 with the reference frequency and outputs the precision event time 32 of the measured signal, which is a result of the measurement, to the outside.

In addition, a signal of a 1 pps 31 is outputted from the high precision event timer for one-second time recognition.

Figure 4:
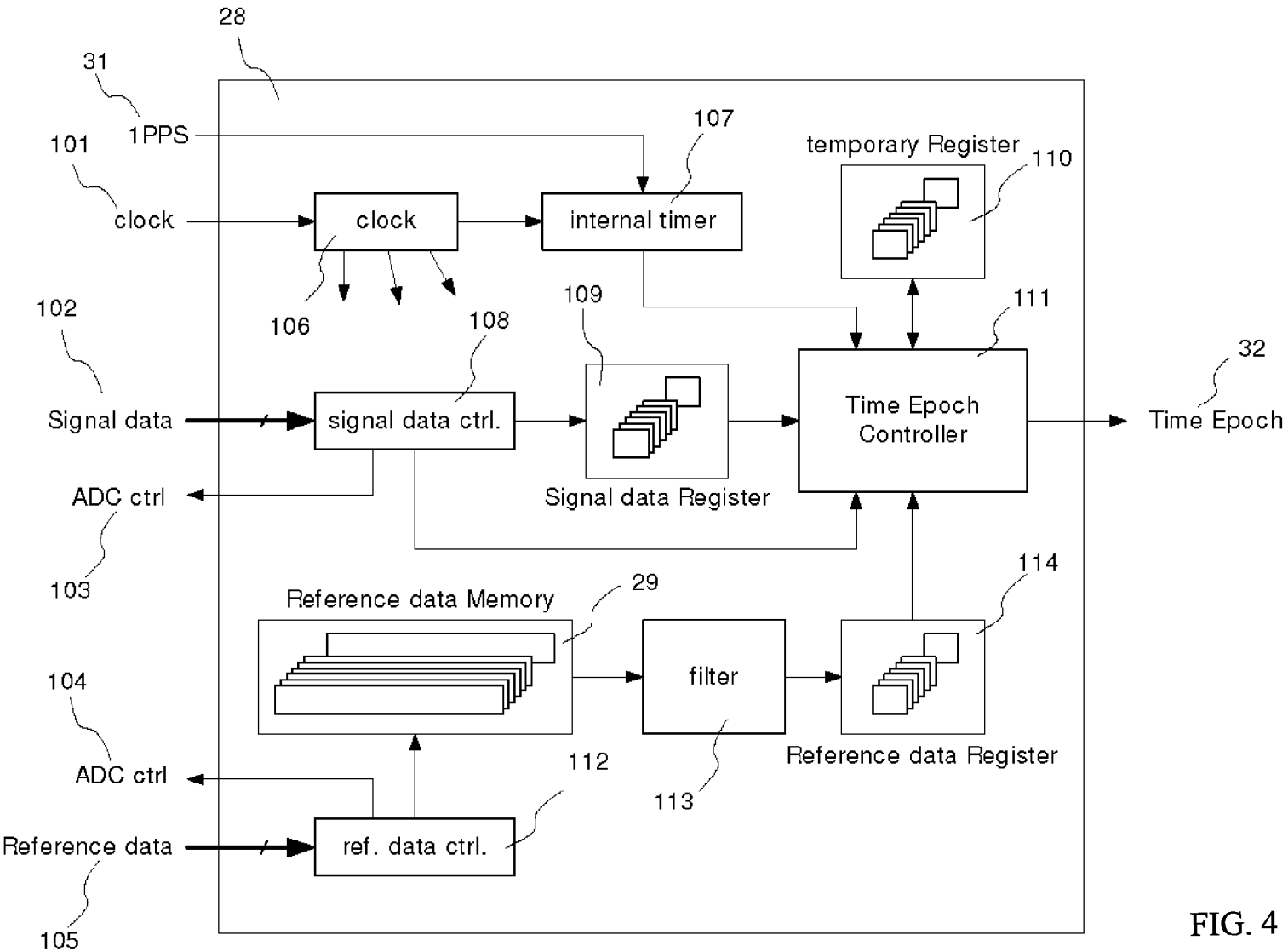
FIG. 4 is a detailed block diagram of an event time measurement controller of FIG. 3.

FIG. 4 is a detailed block diagram of an event time measurement controller of FIG. 3. As shown therein, the precision event time determination is performed by the digital method in accordance with a data which is converted into the digital form after the completion of the analog process.

Since the result value is not affected by the changes in the temperature or the changes in the semiconductor when the data is converted into a digital form, the precision event time is determined by various digital signal process procedures in accordance with the inputted digital data.

The event time measurement controller 26 will be described with reference to FIG. 4.

The event time measurement controller 28 comprises an internal clock 107, a reference digital data input processor 112, a reference data storing memory 29, a reference digital data process filter 113, a reference digital data storing register 114, a measurement digital data input processor 108, a measurement digital temporal storing register 109 and an event time measurement main controller 111.

The internal clock 107 generates a time to be used in the interior of the the measurement controller 28, and receives a frequency signal 101 outputted from the frequency multiplier 27, which signal is to be used for an event time determination of more than an analog-digital sampling period, and determines the time of more than one unit second by using the 1 pps 31 or one unit second recognition.

The reference digital data input processor 112 generates a signal (ADC ctrl) 104 used for controlling the reference frequency analog-digital converter 26 and controls the reference frequency signal analog-digital converter 26 and receives the outputted digital value (reference data) 105.

The reference data storing memory 29 stores the data (reference data) inputted into the reference digital data input processor 112.

The reference digital data process filter 113 serves to determine the precision reference value in accordance with multiple data stored in the reference data storing memory 29.

The reference digital data process filter 113 determines the time of the input signal by a method that the input signals to be measured are compared at the reference time in order to measure precision event time in the semiconductor. The filter generates a time to be used as a reference.

The reference digital data process filter 113 generates a reference data by the movement average method in accordance with the sampling data of the reference signals, which are continuously inputted, as the period of the reference signal.

Figure 5:
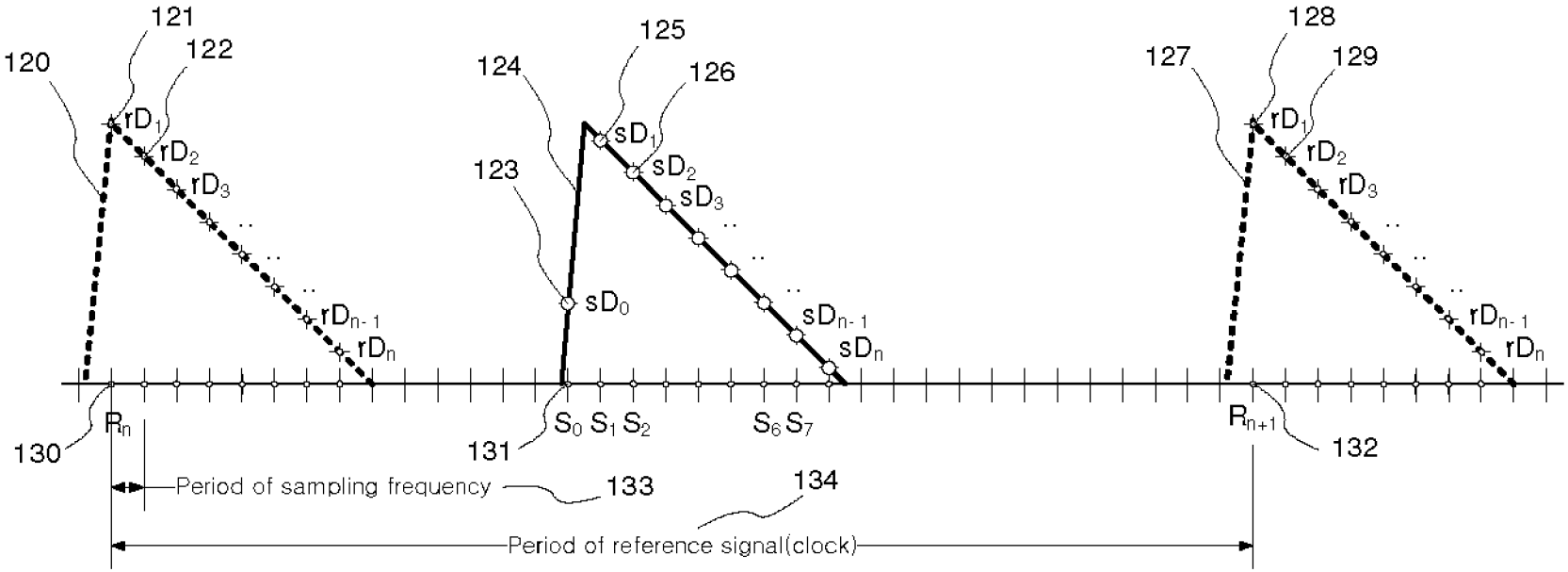
FIG. 5 is a view of a waveform of a reference and a waveform of a measurement signal in order to describe a precision event time determination method of an inputted measurement digital data in accordance with a reference digital data according to the present invention.

For example, the first reference data value is determined with the average value of two data in accordance with 121st value and 128th value of FIG. 5. For the second reference data value, the average is obtained with 122nd value and 129th value, thus determining the second reference data value. In an embodiment of the present invention, two data have been used; however the reference value is determined by using as much as the set size. In addition, the reference data are used as many as the set n-number.

The reference digital data storing register 114 stores a result value processed by the reference digital data process filter 13.

The measurement digital data input processor 108 generates a signal (ADC ctrl) 103 for controlling the measurement signal analog-digital converter 23, thus controlling the measurement signal analog-digital converter 23 and receiving the outputted digital value (signal data) 102.

The measurement digital temporal storing register 109 stores the data (signal data) inputted into the measurement digital data input processor 108.

Figure 1:
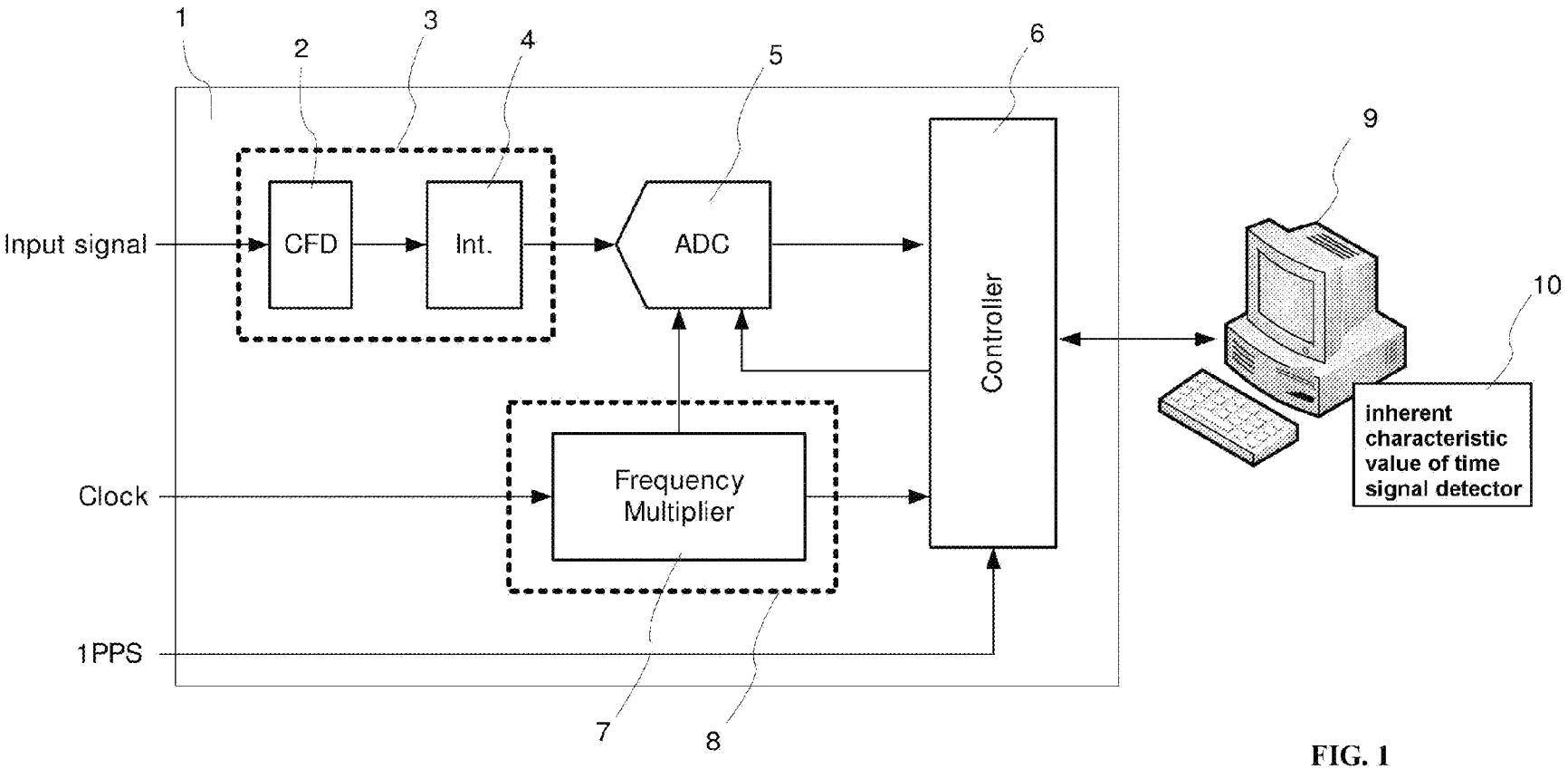
FIG. 1 is a view illustrating a construction of a conventional high precision event timer.
Figure 2:
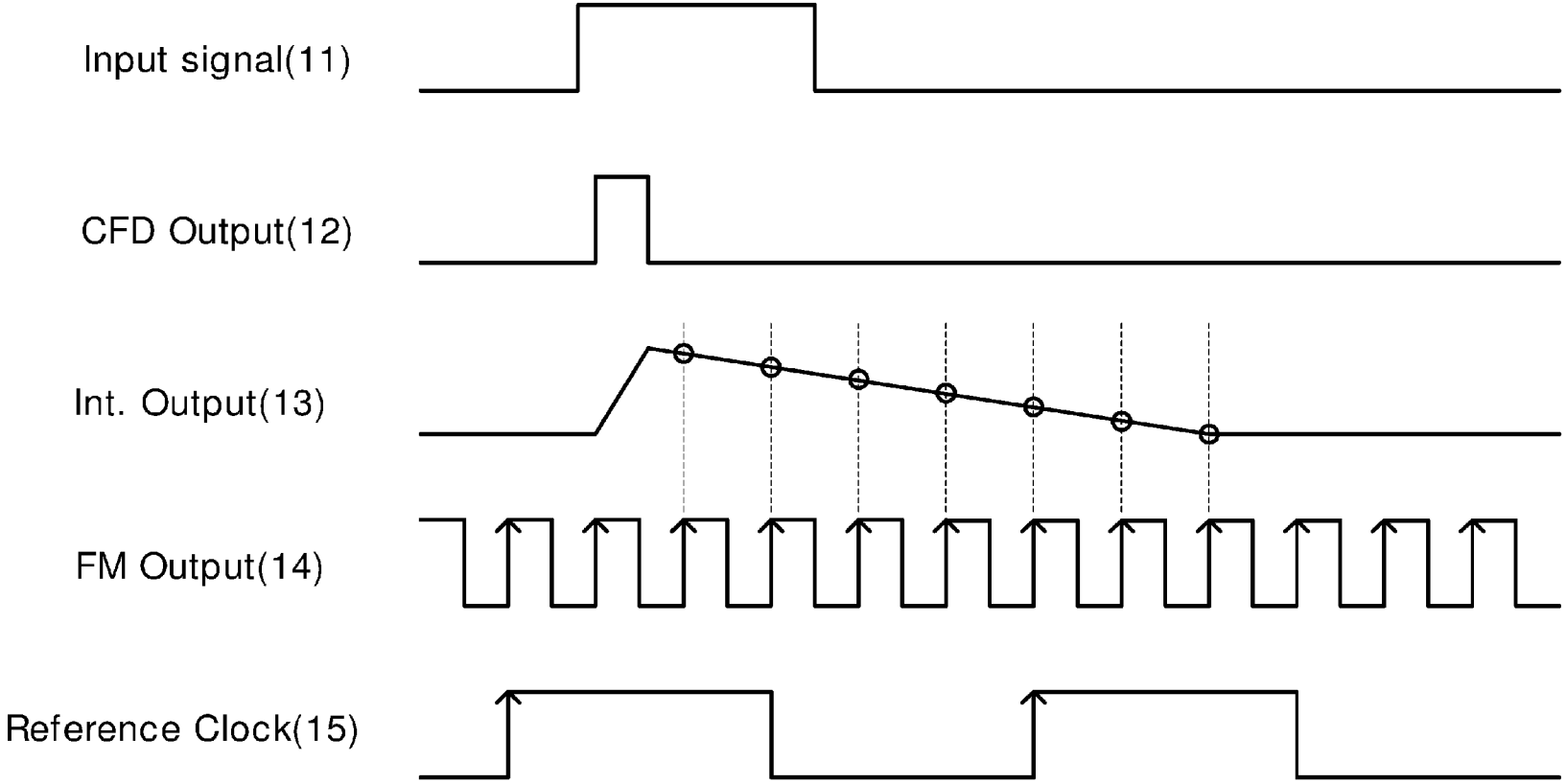
FIG. 2 is a view of a signal waveform of a conventional high precision event timer.

The event time measurement main controller 111 serves to determine a time in accordance with time information measured by the internal clock 107 when new data for measurements are inputted into the measurement digital data temporal storing register 109 and serves to compute the values of the measurement digital data storing register 109 based on the output value of the reference digital data process filter 113 stored in the reference digital data storing register 114, thus determining the precision event time. In other words, the formula of the precision event time determination of FIG. 1 is computed. In the formula, the data of sD1, sD2, sD3 . . . sDn−1, sDn correspond to the values in the measurement digital data storing register (refer to the descriptions of FIG. 5).

The above operation will be described.

The event time measurement controller 29 processes the measurement digital data 102 from the measurement signal analog-digital converter 23 by a digital signal process method, thus computing the precision event time 32 and outputting the computed data to the outside.

The frequency signal 101 outputted from the frequency multiplier 27 is inputted into the event time measurement controller 29, namely, into various function blocks of the event time measurement controller 29.

Some signals of the frequency signals 101 outputted from the frequency multiplier 27 are transferred to the internal clock 107 which generates time to be used in the interior of the event time measurement controller 29, thus being used for an event time determination more than the analog-digital sampling period.

The internal clock 107 determines the time more than one second unit by using the 1 pps 31 for one second unit time recognition in addition to the frequency signal 101.

The reference digital data input processor 112 generates a signal (ADC ctrl) 104 for controlling the reference frequency signal analog-digital converter 26 and controls the reference frequency signal analog-digital converter 26 and receives the outputted digital value (reference data) 105.

The data (reference data) inputted into the reference digital data input processor 112 is stored in the reference data storing memory 29.

The reference data storing memory 29 is to prevent the reference data from changing due to the errors such as noises or the like when using the unit level data as a reference when generating the reference data, and the reference data does not use the data of the unit level, but is made from a stable reference data by processing multiple reference data.

Here the unit level data is the data on the sampled frequency signal obtained while multiple sampling data are constituted in accordance with a high speed frequency in such a manner that the standard frequency signal used as a reference is extended by the integrator and means the data formed of $rD_1$, $rD_2$, $rD_3$, $rD_{n-1}$, $rD_n$ of FIG. 5.

The reference digital data process filter 113 serves to determine the precision reference value in accordance with multiple data stored in the reference data storing memory 29, the output value of which reference digital data process filter 113 is stored in the reference digital data storing register 114 and is used for a precision event time determination of the measurement digital data in the event time measurement main controller 111.

The measurement digital data input processor 108 generates a signal (ADC ctrl) 103 used for controlling the measurement signal analog-digital converter 23 and controls the measurement signal analog-digital converter 23 and receives the outputted digital value (signal data) 102.

The data (signal data) inputted into the measurement digital data input processor 108 is stored in the measurement digital temporal storing register 109 for the event time measurement main controller 111 to use the data at a necessary time.

The event time measurement main controller 111 determines a time until the in accordance with time information measured by the internal clock 107 when new data are inputted into the measurement digital data temporal storing register 109 for a measurement, and the time information more precise than the sampling frequency helps compute the value of the measurement digital data storing register 109 based on the output value of the reference digital data process filter 113 stored in the reference digital data storing register 114, thus determining the precision event time.

The finally outputted precision event time is determined in accordance with the above two values. The temporal data generated during the above computation are stored in the temporal register 110 to be used when determining a precision event time.

FIG. 5 is a view of a waveform of a reference and a waveform of a measurement signal in order to describe a precision event time determination method of an inputted measurement digital data in accordance with a reference digital data according to the present invention.

As shown therein, since the apparatus and method for forming the reference signal waveform and the measurement signal waveform are same, the same waveforms can be obtained. Since the reference signal and the measurement signal change equally with respect to the external change which affects the characteristics of the semiconductor such as temperature changes, the relative errors can be minimized.

The output signals from the measurement signal analog-digital converter and the reference frequency analog-digital converter have tooth-shapes like the input signal waveform 120 of the reference signal of FIG. 5, the input signal waveform 124 of the measurement signal and the input signal waveform 127 of the next reference signal.

The above construction will be described in more details. When the analog-processed reference frequency signal, which is an output signal of the reference frequency signal integrator 25, is inputted into the reference frequency signal analog-digital converter 26, the analog signal is converted into the digital data in accordance with a sampling frequency from the reference digital input processor 112. The data of the digital-converted reference signal is stored into the reference data storing memory 29 in a sequence of the first digital value 121 of the reference signal, and the second digital data value 122 of the reference signal.

The processing methods of the next reference signals are same. In other words, when the next reference signal is inputted into the reference frequency signal analog-digital converter 26 after the next reference signal is analog-processed, the analog signal is converted into a digital data in accordance with a sampling frequency outputted from the reference digital input processor 113. The data of the next reference signal following the conversion into the digital form is stored into the reference data storing memory 29 in a sequence of the first digital data value 128 of the next reference signal, and the second digital value 129 of the next reference signal.

When the analog-processed measurement signal, which is an output signal of the measurement signal integrator 22, is inputted into the measurement signal analog-digital converter 23, the analog signal is converted into a digital data in accordance with a sampling frequency outputted from the measurement digital data input processor 108. The data of the digital-converted measurement signal is stored in the measurement digital data temporal storing register 109 in a sequence of the first digital value 123 of the measurement signal, the second digital data value 125 of the measurement signal, and the third data value 126 of the measurement signal.

The above signal (the digital data value of the measurement signal) and the reference signal (the digital data value of the reference signal) are different in the points that since the sampling times of two signals are different depending on each signal, the digital data value of the rising point cannot be computed for the reference signal (the digital data value of the reference signal), whereas the first digital data value 123 of the rising time for the measurement signal (the digital data value of the measurement signal) can be measured.

The first digital data value 123 of the rising point of the measurement signal (the digital data value of the measurement signal) is not necessary for a precision event time measurement, but it is needed to remove since such value is always generated.

The method for removing the value is performed in such a way to compare two continuous data and discard the earlier appearing data when the earlier appearing data between the two continuous data is smaller than the following data.

The following is the formula for a precision event time determination.

$T_{PREC}$: determined precision event time ${}_rD_1, {}_rD_2, {}_rD_3 \ldots {}_rD_n$: digital data value of reference signal ${}_sD_1, {}_sD_2, {}_sD_3 \ldots {}_sD_n$: digital data value of measurement signal $T_{SP}$: sampling period of analog-digital converter $S_0$: first digital data value sampling time of measurement signal n: number of designated samplings $$T_{PREC} = \left(\left(\frac{\left(\frac{rD_1 - sD_1}{rD_1 - rD_2} + \frac{rD_2 - sD_2}{rD_2 - rD_3} + \ldots + \frac{rD_{n-1} - sD_{n-1}}{rD_{n-1} - rD_n}\right)}{n-1}\right) \times T_{SP}\right) + S_0$$

The formula for the precision event time determination will be described in details.

First, the ratios of $\{({}_rD_1 - {}_sD_1,)/({}_rD_1 - {}_sD_2)\}$ of the positions of one sampling reference signal to the measurement signal are computed. The input signal as much as the designated number (n−1) is sampled, and $\{({}_rD_1 - {}_sD_1,)/({}_rD_1 - {}_sD_2), ({}_rD_2 - {}_sD_2,)/({}_rD_2 - {}_sD_3,), \ldots ({}_rD_{n-1} - {}_sD_{n-1})/({}_rD_{n-1} - {}_sD_n)\}$ are computed. Here, multiple sampling data are used in order to minimize the quantization errors of the analog-digital converter.

The average value of the above result values is computed, and the computed average value is multiplied by the sampling period ($T_{SP}$) which is supplied to the analog-digital converter, thus computing the time information of the precision lower than the sampling period. The time information larger than the sampling period which is supplied to the analog-digital converter uses the first digital data value sampling time 131 of the measurement signal.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

DESCRIPTIONS OF REFERENCE NUMERALS

1: event time signal detector
2: CFD (Constant Fractional Discriminator)
3: input signal temperature control heater
4: integrator
5: analog-digital converter (ADC)
6: signal controller
7: frequency multiplier
8: frequency multiplier temperature control heater
9: signal processor
10: inherent characteristic value of time signal detector
11: event time measurement input signal
12: output signal of CFD
13: output signal of integrator
14: output signal of frequency multiplier
15: input signal of reference frequency
20: measurement signal inputted into high resolution timer
21: event time measurement delay unit
22: measurement signal integrator
23: measurement signal analog-digital converter
24: reference frequency signal delay unit
25: reference frequency signal integrator
26: reference frequency signal analog-digital converter
27: frequency multiplier
28: high resolution event time measurement controller
29: reference data storing memory
30: reference frequency signal
31: 1 pps
101: frequency signal outputted from frequency multiplier
102: measurement digital data outputted from measurement signal analog-digital converter
103: measurement signal analog-digital converter control signal
104: reference frequency signal analog-digital converter control signal
105: reference digital data outputted from reference frequency signal analog-digital converter
106: high resolution event time measurement controller frequency distributor
107: high resolution event time measurement controller internal clock
108: measurement digital data input processor
109: temporal storing register of measurement digital data
110: temporal register for event time determination of event time measurement main controller
111: event time measurement main controller
112: reference digital data input processor
113: reference digital data processing filter
114: reference digital data storing register
120: input signal waveform of reference signal
121: first digital data value of reference signal
122: second digital data value of reference signal
123: first digital data value of measurement signal
124: input signal waveform of measurement signal
125: second digital data value of measurement signal
126: third digital data value of measurement signal
127: input signal waveform of next reference signal
128: first digital data value of next reference signal
129: second digital data value of next reference signal
130: first digital data value sampling time of reference signal
131: first digital data value sampling time of measurement signal
132: first digital data value sampling time of next reference signal
133: sampling period of analog-digital converter
134: period of reference signal

What is claimed is:

1. A self temperature-compensated high precision event timer, comprising:

a measurement signal delay unit which converts a measurement signal into a pulse signal;

a measurement signal integrator which converts an output signal from the measurement signal delay unit into a tooth-shaped waveform signal;

a measurement signal analog-digital converter which converts an output signal from the measurement signal integrator into a digital signal;

a reference frequency signal delay unit which converts a reference frequency signal into a pulse signal and has a same structure as the measurement signal delay unit;

a reference frequency signal integrator which converts an output signal from the reference frequency signal delay unit into a tooth-shaped waveform signal and has a same structure as the measurement signal integrator;

a reference frequency analog-digital converter which converts an output signal from the reference frequency signal integrator and has a same structure as the measurement signal analog-digital converter;

a frequency multiplier which converts the reference frequency signal into a frequency signal needed to the measurement signal analog-digital converter and the reference frequency analog-digital converter; and an event time measurement controller which processes by a digital signal process method the digital signal outputted from the measurement signal analog-digital converter, thus computing a precision event time.

2. The timer of claim 1, wherein said event time measurement controller comprises:

an internal clock which generates a time used in the interior of the event time measurement controller, and receives a frequency signal outputted from the frequency multiplier, and is used for an event time determination of more than an analog-digital sampling period, and determines a time more than one unit second by using a 1 pps for a one unit second time recognition;

a reference digital data input processor which generates a reference frequency signal analog-digital converter control signal, and controls the reference frequency signal analog-digital converter, and receives an outputted digital value from the reference frequency signal analog-digital converter;

a reference data storing memory which stores data inputted into the reference digital data input processor;

a reference digital data process filter which determines a precision reference value by using multiple data stored in the reference data storing memory;

a reference digital data storing register which stores a result value processed by the reference digital data processing filter;

a measurement digital data input processor which generates a measurement signal analog-digital converter control signal, and controls the measurement signal analog-digital converter and receives an outputted digital value from the measurement signal analog-digital converter;

a measurement digital temporal storing register which stores data inputted into the measurement digital data input processor; and an event time measurement main controller which determines a time in accordance with time information measured by the internal clock when new data are inputted into the measurement digital data temporal storing register for measurement, and determines the time by computing a value of the measurement digital data storing register based on an output value of the reference digital data process filter stored in the reference digital data storing register.

3. The timer of claim 2, wherein said precision event time is determined by the following formula:

$$T_{PREC} = \left(\left(\frac{\left(\frac{rD_1 - sD_1}{rD_1 - rD_2} + \frac{rD_2 - sD_2}{rD_2 - rD_3} + \ldots + \frac{rD_{n-1} - sD_{n-1}}{rD_{n-1} - rD_n}\right)}{n-1}\right) \times T_{SP}\right) + S_0$$

where $T_{PREC}$ means the precision event time, and ${}_rD_1$, ${}_rD_2$, ${}_rD_3 \ldots {}_rD_n$ means a digital data value of the reference frequency signal, and, ${}_sD_1$, ${}_sD_2$, ${}_sD_3 \ldots {}_sD_n$ means a digital data value of the measurement signal, $T_{SP}$ means the sampling period of the analog-digital converter, and, $S_0$ means the first digital data value sampling time of the measurement signal, and, n means a number of designated samples.

4. The timer of claim 1, wherein said measurement signal integrator and said reference frequency signal integrator are formed of a capacitor and an OP amplifier (OP Amp), and said frequency multiplier is formed of a voltage control oscillator (VCO).

5. A self temperature-compensated high precision event time measurement method, comprising:

a step for converting a measurement signal into a tooth-shaped waveform digital signal by using a measurement signal delay unit, a measurement signal integrator, and a measurement signal analog-digital converter;

a step for converting a reference frequency signal into a tooth-shaped waveform digital signal by using a reference frequency signal delay unit, a reference frequency signal integrator and a reference frequency signal analog-digital converter which each has a same structure as each of the measurement signal delay unit, the measurement signal integrator, and the measurement signal analog-digital converter, respectively;

a step for determining a time in accordance with time information measured by an internal clock;

a step for determined a precision event time by using the following formula:

$$T_{PREC} = \left(\left(\frac{\left(\frac{rD_1 - sD_1}{rD_1 - rD_2} + \frac{rD_2 - sD_2}{rD_2 - rD_3} + \ldots + \frac{rD_{n-1} - sD_{n-1}}{rD_{n-1} - rD_n}\right)}{n-1}\right) \times T_{SP}\right) + S_0$$

where $T_{PREC}$ means the precision event time, and ${}_rD_1$, ${}_rD_2$, ${}_rD_3 \ldots {}_rD_n$ means the digital data value of the reference frequency signal, and, ${}_sD_1$, ${}_sD_2$, ${}_sD_3 \ldots {}_sD_n$ means a digital data value of the measurement signal, $T_{SP}$ means a sampling period of the analog-digital converter, and, $S_0$ means the first digital data value sampling time of the measurement signal, and, n means a number of designated samples.

6. The method of claim 5, said measurement signal integrator and said reference frequency signal integrator are formed of a capacitor and an OP amplifier (OP Amp), and said frequency multiplier is formed of a voltage control oscillator (VCO).

* * * * *